US007677273B2

(12) United States Patent
Skaflestad

(10) Patent No.: US 7,677,273 B2
(45) Date of Patent: Mar. 16, 2010

(54) BEADING LOOM WITH REMOVABLE WARP THREAD CARTRIDGE

(76) Inventor: Kristine K. Skaflestad, P.O. Box 177, Hoonah, AK (US) 99829

( * ) Notice: Subject to any disclaimer, the term of this patent is extended or adjusted under 35 U.S.C. 154(b) by 37 days.

(21) Appl. No.: 12/155,098

(22) Filed: May 29, 2008

(65) Prior Publication Data

US 2009/0293982 A1 Dec. 3, 2009

(51) Int. Cl.
*D03D 29/00* (2006.01)
*D03J 1/13* (2006.01)
*D03D 41/00* (2006.01)

(52) U.S. Cl. ..... 139/29; 139/1 R; 139/30; 139/31; 139/32; 139/34

(58) Field of Classification Search ..... 139/1 R, 139/29–34
See application file for complete search history.

(56) References Cited

U.S. PATENT DOCUMENTS

| | | | | | |
|---|---|---|---|---|---|
| 1,893,538 | A | * | 1/1933 | Ederer | 223/48 |
| 1,995,384 | A | * | 3/1935 | Fletcher | 28/151 |
| 2,043,082 | A | * | 6/1936 | Wallach | 28/151 |
| 2,094,505 | A | * | 9/1937 | Thackeray | 139/33 |
| 2,110,822 | A | * | 3/1938 | Roberts | 139/33 |
| 2,139,879 | A | * | 12/1938 | Clark et al. | 139/33 |
| 2,146,991 | A | * | 2/1939 | Rowntree et al. | 139/91 |
| 2,150,187 | A | * | 3/1939 | Raba et al. | 139/33 |
| 2,209,597 | A | * | 7/1940 | Clark et al. | 139/33 |
| 2,224,563 | A | * | 12/1940 | Clark | 139/33 |
| 2,241,318 | A | * | 5/1941 | Robson | 139/33 |
| 2,359,695 | A | * | 10/1944 | Turner | 139/1 R |
| 2,601,222 | A | * | 6/1952 | Wehrli | 28/151 |
| 2,707,316 | A | * | 5/1955 | Doniger | 28/151 |
| 2,769,461 | A | | 11/1956 | Kaufmann | |
| 2,780,854 | A | * | 2/1957 | Dritz | 28/152 |
| 2,802,255 | A | * | 8/1957 | Wallach | 28/151 |
| 2,818,085 | A | | 12/1957 | Landry | |
| 2,903,019 | A | | 9/1959 | Knopf | |
| 3,636,987 | A | * | 1/1972 | Forby | 28/151 |
| 3,680,598 | A | * | 8/1972 | Kunz | 139/1 R |
| 3,708,839 | A | | 1/1973 | Prince | |
| 3,724,041 | A | * | 4/1973 | Cleverley | 28/149 |
| 3,996,969 | A | * | 12/1976 | McCullough et al. | 139/29 |
| 4,016,183 | A | | 4/1977 | Wallach | |
| 6,719,013 | B1 | * | 4/2004 | D'Estais | 139/29 |
| 7,147,008 | B2 | * | 12/2006 | Sayler | 139/29 |
| 2004/0069363 | A1 | * | 4/2004 | D'Estais | 139/1 R |
| 2005/0066866 | A1 | | 3/2005 | Pederzini | |
| 2005/0247745 | A1 | | 11/2005 | Spor et al. | |

FOREIGN PATENT DOCUMENTS

| | | |
|---|---|---|
| JP | 2000355848 | 12/2000 |
| JP | 2002088616 | 3/2002 |

* cited by examiner

*Primary Examiner*—Bobby H Muromoto, Jr.
(74) *Attorney, Agent, or Firm*—Richard C. Litman

(57) ABSTRACT

The beading loom with a removable warp thread cartridge has warp threads mounted in a cartridge that is removably received in a frame of the loom, allowing the user to bead the threads in a conventional manner, but without having to wrap the threads on the loom manually. Once finished with one beading product, the user may then remove the cartridge from the loom and replace the beaded project with a fresh cartridge of warp threads. The frame has an elongated base having an adjustable length along the longitudinal direction.

12 Claims, 4 Drawing Sheets

BEADING LOOM WITH REMOVABLE WARP THREAD CARTRIDGE

BACKGROUND OF THE INVENTION

1. Field of the Invention

The present invention relates to weaving devices, and particularly to a beading loom with a removable warp thread cartridge for making beaded jewelry and fabrics.

2. Description of the Related Art

In order to make beaded artwork, threads are typically strung across opposed ends of a loom. These threads are conventionally referred to as "warp" threads. The length and width of the beadwork is defined by how many threads are strung on the loom. Typical beadwork is limited to the size of the loom, which is generally a fixed frame or structure.

In order to string a conventional loom, the thread is attached to one end thereof and then run to the other side of the loom, where it is wrapped around a small nail or peg. The thread is then run back to the first side to be wrapped around another nail or peg. This process is continued until the desired number of warp threads is strung on the loom. Since a large number of warp threads are typically utilized in a beadwork project, this manual stringing is extremely time consuming. Further, the threads may become easily tangled, or may snap during the threading process. Additionally, the user is required to keep the threads under constant tension during the stringing process, which becomes increasingly difficult as more warp threads are added. Once the loom is strung, the user may add "weft" threads and beads in the conventional manner.

Thus, a beading loom with removable warp thread cartridge solving the aforementioned problems is desired.

SUMMARY OF THE INVENTION

The beading loom with a removable warp thread cartridge has warp threads that are mounted within a cartridge, which is removably received in a frame of the loom, allowing the user to bead the threads in a conventional manner, but without having to wrap the threads on the loom manually. Once finished with one beading product, the user may then remove the cartridge from the loom and replace the beaded project with a fresh cartridge of warp threads.

As noted above, the loom includes a frame. The frame has an elongated base, with the elongated base having opposed first and second ends. Preferably, the base of the frame has an adjustable length along the longitudinal direction. The frame further includes first and second mounting members secured to the respective first and second ends of the elongated base.

The warp thread cartridge has a pair of longitudinally opposed retaining members and a plurality of warp threads extending between the longitudinally opposed retaining members. In use, the pair of longitudinally opposed retaining members are releasably secured to the first and second mounting members.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
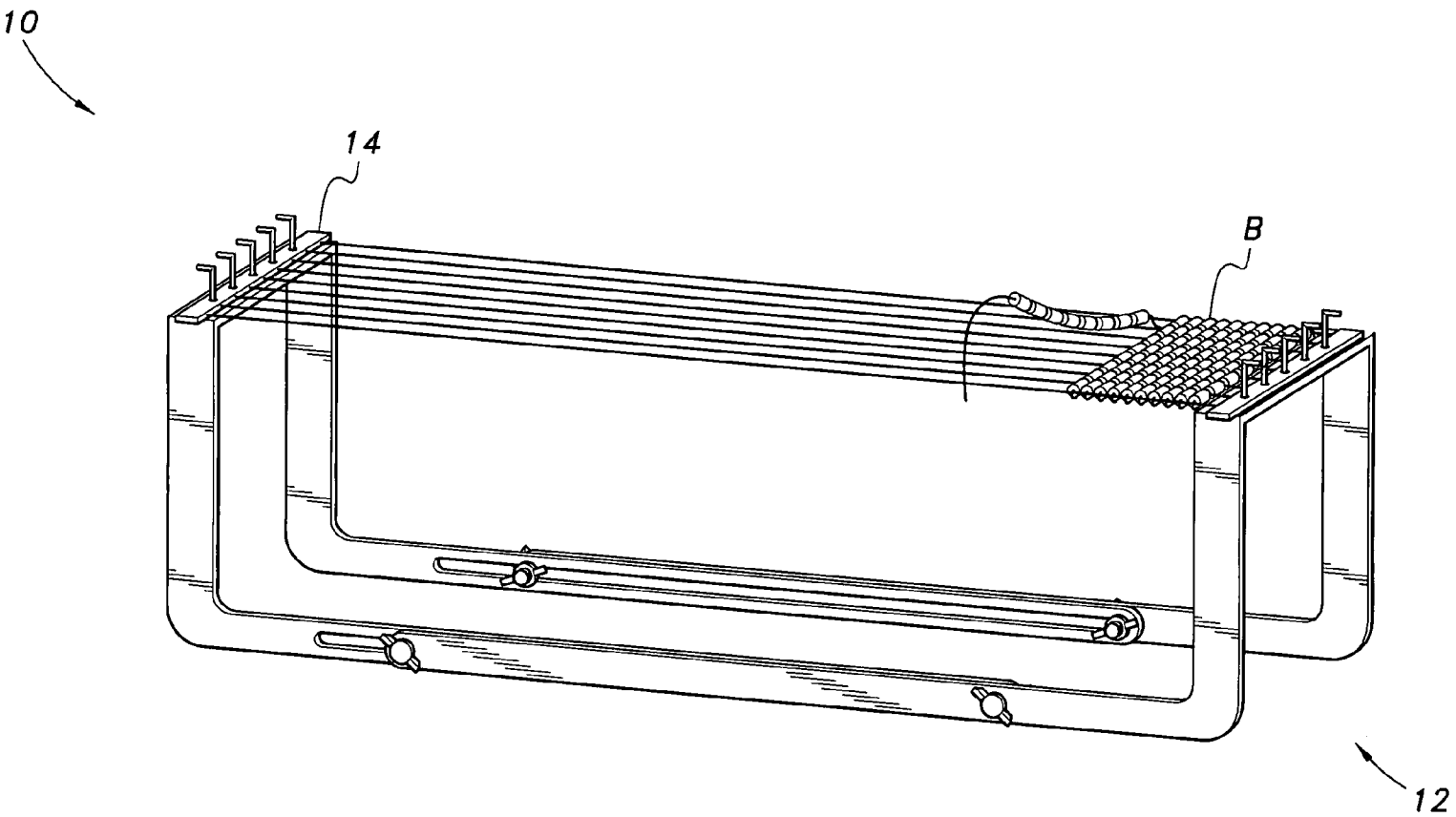
FIG. 1 is an environmental, perspective view of a beading loom with a removable warp thread cartridge according to the present invention.

The present invention is directed towards a beading loom with a removable warp thread cartridge, designated generally as 10 in the drawings. As will be described in greater detail below, the warp threads 20 are mounted within a cartridge 14, which is removably mounted on a frame 12 of the loom 10, allowing the user to bead the threads in a conventional manner, but without having to wrap the threads on the loom manually. Once finished with one beading product, the user may then remove the cartridge 14 from the loom 10 and replace the beaded project with a fresh cartridge 14 of warp threads. The cartridges 14 may be provided with any suitable type of threads 20, depending on the nature of the user's intended project or product. Cartridges 14 may be manufactured in a wide variety of lengths and widths, in a wide variety of differing types of thread, and with differing numbers of warp threads 20, allowing for multiple different types of artwork and projects to be made with the frame 12.

Figure 2:
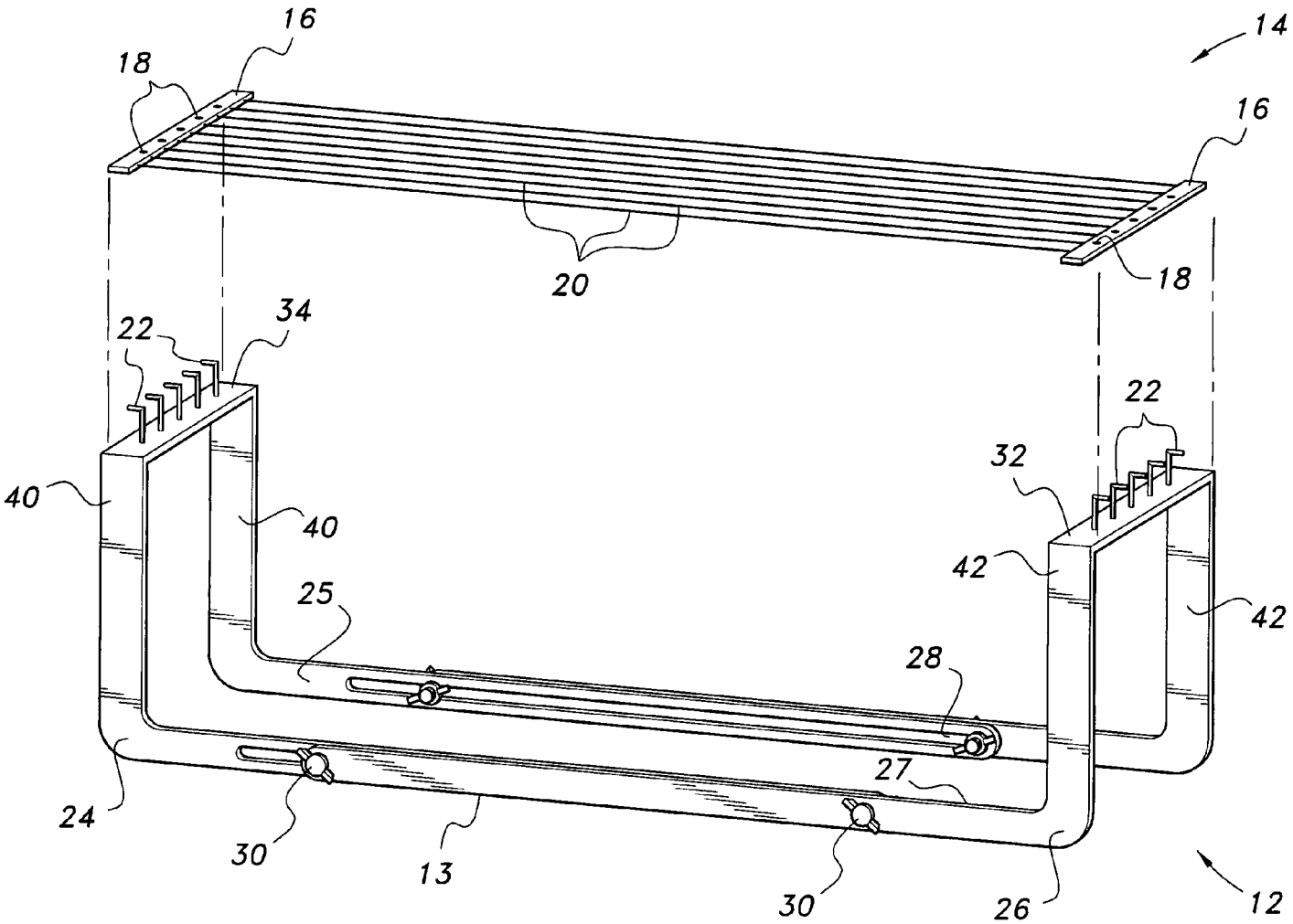
FIG. 2 is a perspective of the beading loom with a removable warp thread cartridge according to the present invention, showing the cartridge exploded from the loom.
Figure 3:
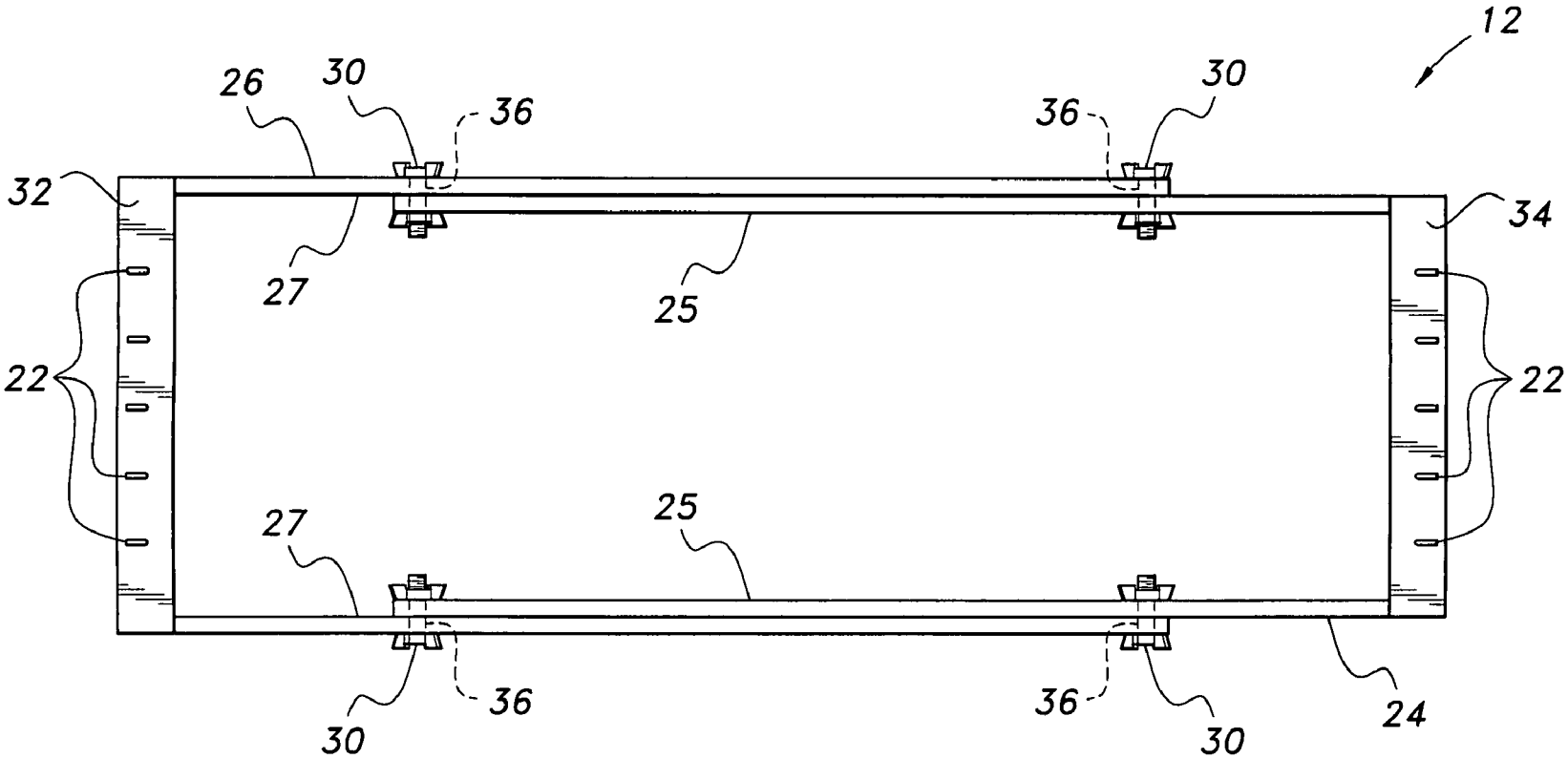
FIG. 3 is a top view of a frame of the beading loom with a removable warp thread cartridge according to the present invention.

As noted above, the loom includes a frame 12. As best shown in FIGS. 2 and 3, the frame 12 has an elongated base 13 having opposed first and second ends. Preferably, the base 13 of the frame 12 has an adjustable length along the longitudinal direction. The frame 12 includes first and second mounting members 34, 32, respectively, secured to the respective first and second ends of the elongated base 13.

Figure 4:
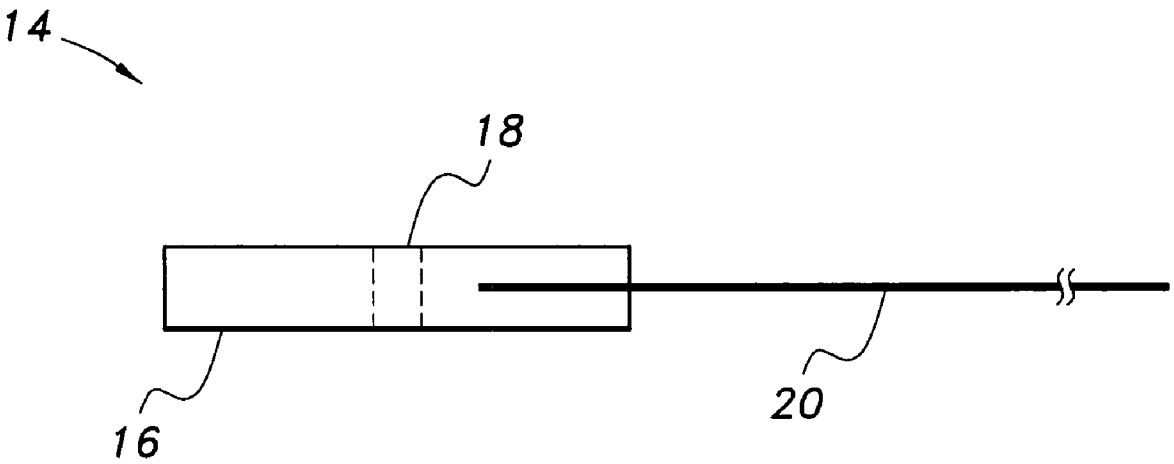
FIG. 4 is a partial side view of a warp thread cartridge for a beading loom with a removable warp thread cartridge according to the present invention.

The warp thread cartridge 14 has a pair of longitudinally opposed retaining members 16 and a plurality of warp threads 20 extending between the pair of longitudinally opposed retaining members 16. In use, the pair of longitudinally opposed retaining members 16 are releasably secured to the first and second mounting members 34, 32, respectively. The retaining members 16 may be formed from plastic, rubber or any other suitable material. Preferably, as shown in FIG. 4, the ends of each thread 20 are embedded within the respective retaining member 16, with the plastic or rubber being molded or otherwise formed therearound.

Preferably, each of mounting members 32, 34 has at least one peg 22 extending therefrom, and at least one corresponding opening 18 is formed through each of the retaining members 16 for releasably receiving a respective one of the pegs 22. Any suitable number of pegs 22 and corresponding openings 18 may be utilized. Further, the pegs 22 may be formed as hooks, as shown, or may have any other suitable shape.

The first and second mounting members 34, 32 are preferably raised with respect to the base 13. First and second supports 40, 42 are respectively secured to the first and second ends of the elongated base 13, with each of the first and second supports 40, 42 having an upper end and a lower end. The lower end thereof is secured to the respective one of the first and second ends of the elongated base 13, and the upper end thereof is secured to the respective one of the first and second mounting members 34, 32.

As shown in FIG. 3, preferably, the frame 12 includes first and second frame members 24, 26, with the first frame member 24 being slidably mounted on the second frame member 26. Each of the first and second frame members 24, 26 includes a base portion having a pair of laterally spaced apart legs 25, 27, respectively, and a pair of vertical support members 40, 42, respectively, each being secured to, and projecting upwardly from, a respective one of the pair of laterally spaced apart legs 25, 27. Each of the first and second mounting members 34, 32 extends laterally between a respective pair of vertical support members 40, 42.

The pair of laterally spaced apart legs 25 of the first frame member 24 each have a longitudinally extending slot 28 formed therethrough (best shown in FIG. 2). The pair of laterally spaced apart legs of the second frame member 27 each has at least one passage 36 formed therethrough (as shown in FIG. 3), so that at least one pair of fasteners 30, such as thumb screws and wing nuts, are releasably and adjustably received through respective adjacent legs 25, 27 of the first and second frame members 24, 26. In order to adjust the length of base 13, the user may loosen or remove the fasteners 30 and slide the first and second frame members 24; 26 with respect to one another.

In use, the user places a cartridge 14 on the frame 12. The user threads a number of beads B equal to the number of slots between adjacent warp threads 20 onto a weft thread. The user then weaves the weft thread onto the stretched out warp threads 20, using a needle to thread the beads over and under adjacent threads 20 in conventional manner, aligning the bead between the warp threads. The process is repeated for the required number of weft threads, and the completed piece is removed from the loom 10.

It is to be understood that the present invention is not limited to the embodiment described above, but encompasses any and all embodiments within the scope of the following claims.

I claim:

1. A beading loom with a removable warp thread cartridge, consisting essentially of:

a frame having an elongated base and opposed first and second ends, the frame having first and second planar mounting members disposed at the respective first and second ends of the elongated base, the frame further comprising first and second vertical supports disposed at the first and second ends of the elongated base and projecting upwardly therefrom, the first and second vertical supports each having an upper end and a lower end, the lower ends extending vertically from the respective first and second ends of said elongated base, the first and second mounting members being attached to the upper ends of the respective first and second vertical supports and extending laterally therefrom;

a warp thread cartridge having a pair of longitudinally opposed, substantially planar retaining members and a plurality of warp threads extending between the retaining members; and means for releasably securing the pair of longitudinally opposed retaining members to the first and second mounting members so as to define a substantially horizontal plane.

2. The beading loom as recited in claim 1, wherein the base of said frame has an adjustable length.

3. The beading loom as recited in claim 1, wherein said frame comprises first and second frame members, the first frame member being slidably mounted on the second frame member.

4. The beading loom with a removable warp thread cartridge as recited in claim 3, wherein each said frame member includes a base portion having a pair of laterally spaced apart legs.

5. The beading loom as recited in claim 4, wherein each of the laterally spaced apart legs of said first frame member has a longitudinally extending slot formed therethrough and each of the laterally spaced apart legs of said second frame member has at least one passage formed therethrough, the beading loom further comprising releasable fasteners extending through the aligned passages and slots of the first and second leg members in order to adjust the length of said frame.

6. The beading loom as recited in claim 1, wherein each said mounting member has at least one peg secured thereto, said cartridge retaining members having at least one opening corresponding to the at least one peg, the peg being insertable through the opening to secure said cartridge retaining members to said mounting members.

7. The beading loom as recited in claim 6, wherein the at least one peg is formed as a hook.

8. A beading loom, comprising:

a frame having an elongated base and opposed first and second ends, the frame having first and second planar mounting members disposed at the respective first and second ends of the elongated base, the frame further comprising first and second vertical supports disposed at the first and second ends of the elongated base and projecting upwardly therefrom, the first and second vertical supports each having an upper end and a lower end, the lower ends extending vertically from the respective first and second ends of said elongated base, the first and second mounting members being attached to the upper ends of the respective first and second vertical supports and extending laterally therefrom; and a warp thread assembly having a pair of longitudinally opposed, substantially planar retaining members and a plurality of warp threads extending between the retaining members, the retaining members being attached to the first and second mounting members so as to define a substantially horizontal plane.

9. The beading loom as recited in claim 8, wherein the warp thread assembly is releasably attached to the mounting members.

10. The beading loom as recited in claim 8, wherein the base of said frame has an adjustable length.

11. The beading loom as recited in claim 8, wherein said frame comprises first and second frame members, the first frame member being slidably mounted on the second frame member.

12. The beading loom with a removable warp thread cartridge as recited in claim 11, wherein each said frame member includes a base portion having a pair of laterally spaced apart legs.

* * * * *